United States Patent [19]

Haff, Jr.

[11] 4,024,824

[45] May 24, 1977

[54] SEWING MACHINE FEEDING AND CUTTING ATTACHMENT FOR ELASTIC STRIPPING

[76] Inventor: Frederick Haff, Jr., 161 Tanners Pond Road, Garden City, N.Y. 11530

[22] Filed: Sept. 5, 1975

[21] Appl. No.: 610,687

[52] U.S. Cl. ..... 112/121.26; 112/130; 112/152

[51] Int. Cl.[2] ..... D05B 21/00

[58] Field of Search ..... 112/121.26, 121.27, 112/130, 152, 141, 136, 203, 205

[56] References Cited

UNITED STATES PATENTS

| | | | |
|---|---|---|---|
| 2,653,559 | 9/1953 | Picucci | 112/152 |
| 3,326,155 | 6/1967 | Paolicelli | 112/141 |
| 3,515,081 | 6/1970 | Miller | 112/130 |

FOREIGN PATENTS OR APPLICATIONS

| | | | |
|---|---|---|---|
| 1,440,079 | 4/1966 | France | 112/121.26 |

OTHER PUBLICATIONS

Southern Garment Manufacturer; dtd. Feb., 1975; pp. 30–31; "New Elastic Feed–in Cut–off Attachment".

*Primary Examiner*—H. Hampton Hunter
*Attorney, Agent, or Firm*—Alexander Mencher

[57] ABSTRACT

Pivotally mounted attachment apparatus for use with sewing machines for controllably elasticizing circular parts of garments or other goods. A substantially upright bracket lockably pivoted to the machine has a main and lateral arm, the main arm affording a downward guidance path for elastic stripping having secured thereto means for feed initiation and metering or tensioning of the elastic stripping. The lateral arm carries the cutting apparatus. Feed initiation, metering or tensioning and cutting means include phased actuating devices fluidically operated and wherein the feed initiation and cutting cycles take place automatically and sequentially by activated controls.

14 Claims, 15 Drawing Figures

10
12
14
16
18
19
21
23
24
25
25'
35
36
46
47
48
49
50
51
55
56
57
58
59
60
61
62
64
66
67
68
69
71
72
73
74
75
82
83
151
152
153
154
155
156
157
158
159
160
161
162
163
164
165
166
167

FIG. 4
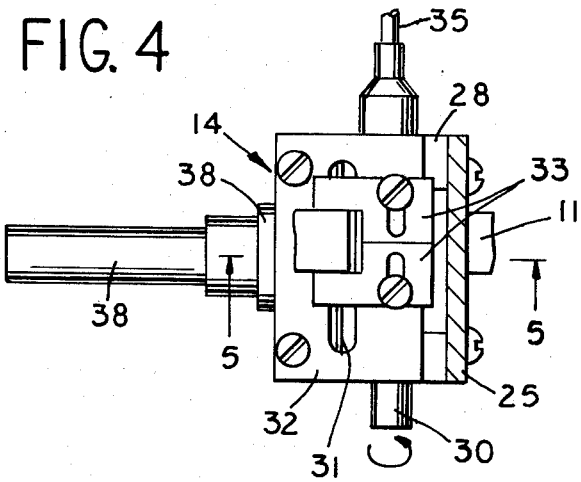
FIG. 3
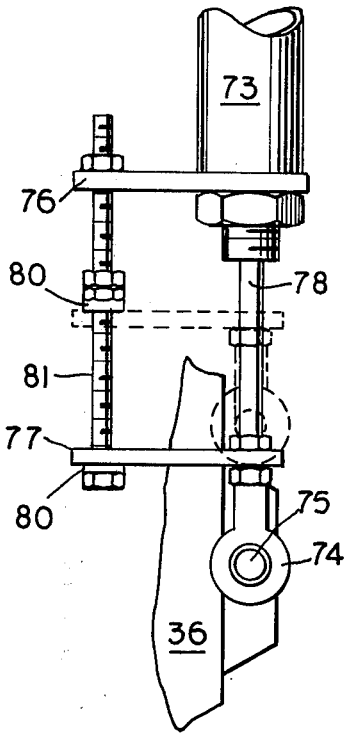
FIG. 5
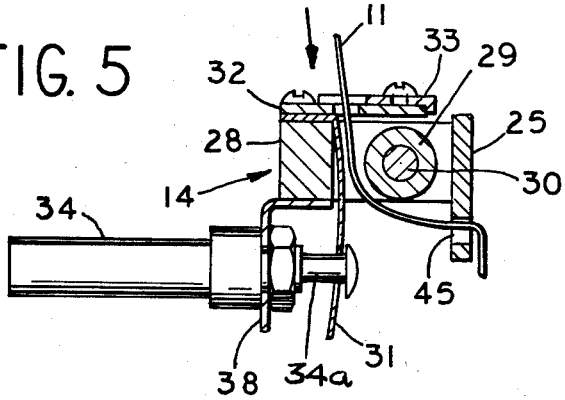
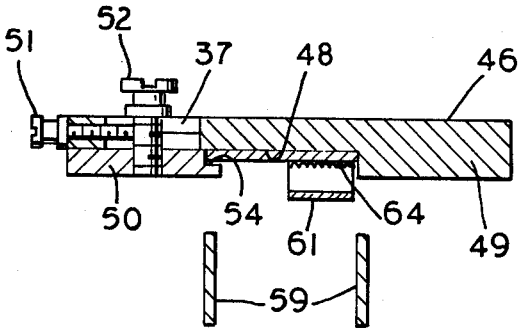
FIG. 6
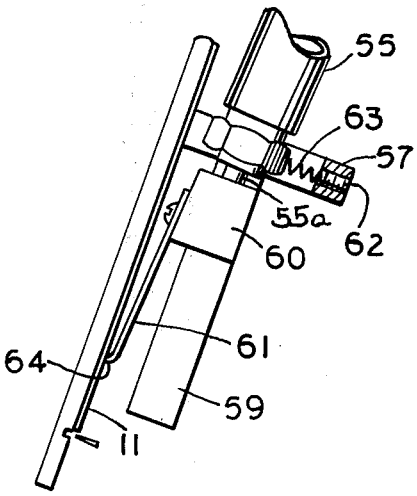
FIG. 7

FIG. 8
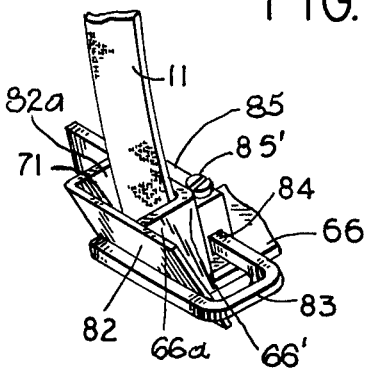
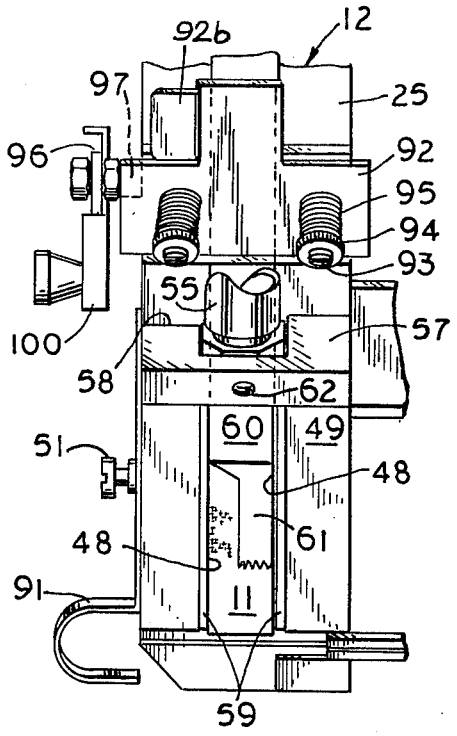
FIG. 9
FIG. 10
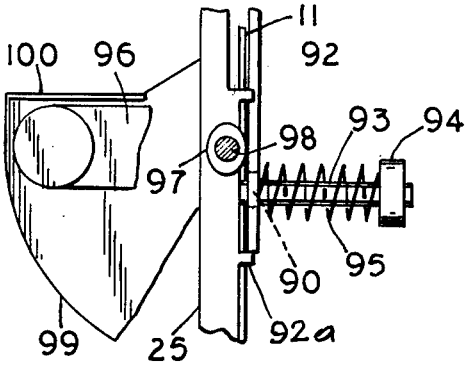
FIG. 11
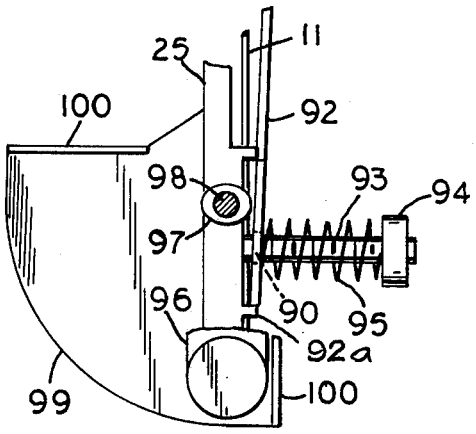
FIG. 12
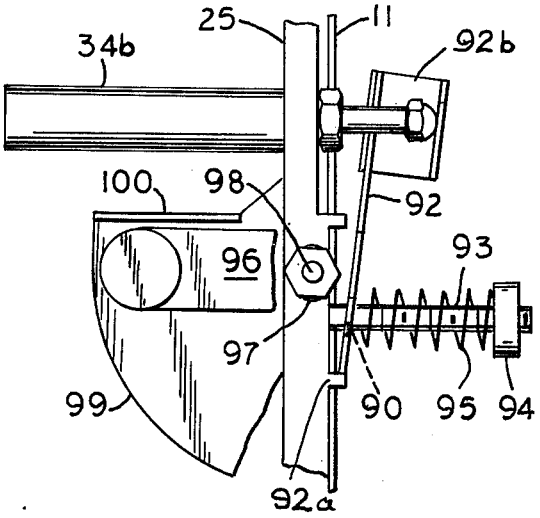

SEWING MACHINE FEEDING AND CUTTING ATTACHMENT FOR ELASTIC STRIPPING

BACKGROUND OF THE INVENTION

Feeding and cutting devices for elastic strips of material adapted to be sewn to a base material as well as metering and/or tensioning devices are known to the art. Moreover, power means such as fluidic air systems (having stationary parts) pneumatic, electrical, electronic or other systems including components and circuitry thereof for operation of actuating means generally are also known in the art.

Prior art fails to show the specific assembly, compact arrangement, friction eliminating means and interconnection of parts adapted for sequential and automatic feeding and cutting cycles employing preferably fluidic power means, all mounted on a suitable bracket attachable to the sewing machine and swingable away from the stitching area.

Most pertinent prior art known to applicant consists of the following U.S. Pat. Nos.:

1,070,137 to Jennings
1,255,501 to Barron
2,685,854 to Ackerman et al.
2,761,401 to Dolney
3,011,460 to Haff, Jr.
3,381,639 to Miller
3,680,509 to Miller

SUMMARY OF THE INVENTION

The invention relates to sewing machines and more particularly to attachable apparatus to industrial type sewing machines and is an improvement over my U.S. Pat. No. 3,011,460 and over my application for patent submitted for filing contemporaneously herewith under the title of Feeding and Cutting Attachment for Sewing Machines and is herein identified under Ser. No. 610,660.

More particularly, the invention relates to novel apparatus and several embodiments to controllably elasticize circular garment parts or other parts of closed items in an efficient and economic manner utilizing suitable control means associated with power means.

A main object of the invention resides in the provision of a novel arrangement of and apparatus for intermittent overhead feeding of elastic stripping and for sequential intermittent cutting thereof in the form of a compact assembly or unit all mounted on a bracket and swingable away from the sewing station or stitch-forming area for purposes of strip insertion and for access to the stitch-forming area. The apparatus includes a guidance system, controllable tensioning and/or metering means for the feed of the stripping, and friction reducing means. Feeding and cutting cycles are phased to operate automatically and sequentially in conjunction with power means and controls therefor as known to the art.

Another object of the invention resides in the provision of apparatus which is compact, easy to apply and operate and efficient and economical in performance.

These objects and other incidental ends and advantages of the invention will hereinafter appear in the progress of the disclosure and as pointed out in the appended claims.

DRAWINGS OF EMBODIMENTS

In the drawings accompanying the specification:

FIG. 3 is a partial plan view of the variable speed drive control for the tensioning or metering mechanism of the elastic material and shows positions for obtaining either medium or fullstretch conditions for said material;

FIG. 4 is a plan view of the drive roller assembly (metering part for the elastic material) driven by the variable speed drive control in FIG. 3 and also including mechanism for applying tension and for adjusting different cleastic material strip widths;

FIG. 5 is a cross-sectional view taken along the line 5—5 of FIG. 4 showing the elastic material in no-stretch condition;

FIG. 6 is an enlarged cross-sectional view taken along the line 6—6 of FIG. 2 showing strip width adjustment means and also part of the hold down method for the feed finger along the feed path:

FIG. 7 is a cross-sectional view taken along the line 7—7 of FIG. 1 showing in detail the adjustable method using to prevent slippage of the elastic material or strip for the feeding stroke.

FIG. 8 is a view in perspective of an adjustable guide throat or funnel associated with the machine presser foot for guidance of the elastic material.

FIG. 9 is a partial front view in elevation of a second fluidic embodiment of the invention showing a manual control method for three strip conditions of stretch or tension;

FIG. 10 is a partial left side view in elevation of the manual control method of FIG. 9 and broken away to show the position of the cam for full-stretch condition;

FIG. 11 is a view similar to FIG. 10 showing the position of the cam for a medium or half-stretch condition;

FIG. 12 is a view similar to FIG. 10 showing the position of the cam for a no-stretch condition;

DESCRIPTION OF EMBODIMENTS OF INVENTION

Figure 1:
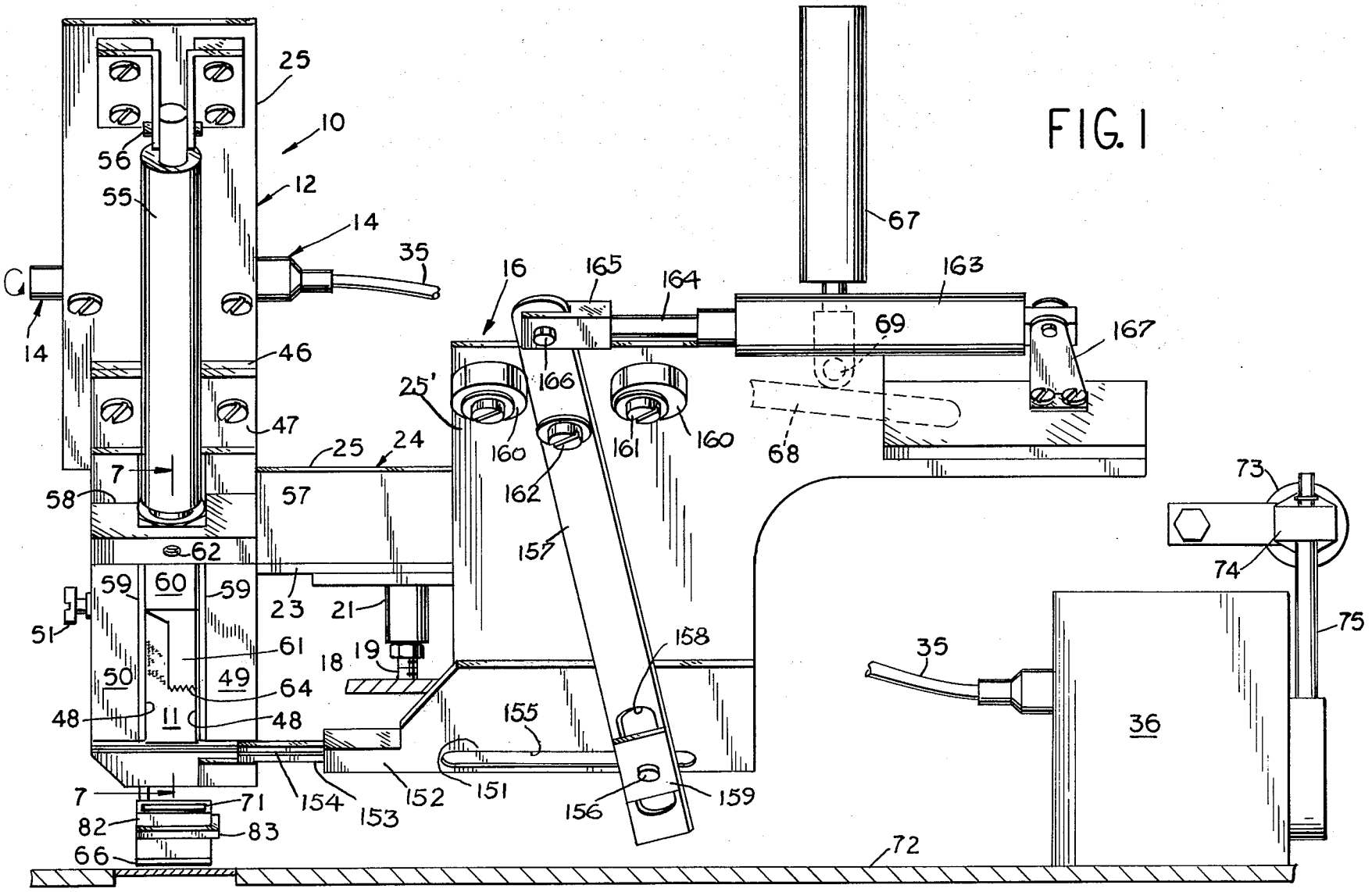
FIG. 1 is a front view in elevation of an assembly unit cooperating with an industrial type of sewing machine and shown in true projection.

The invention herein is presented in three preferred embodiments. Like reference characters are applied to corresponding parts in each embodiment. Similar assemblies and sub-assemblies of parts and operations are described interchangeably in the embodiments.

Structurally and as shown in FIGS. 1–9, the first embodiment of the invention comprises a lockably pivotal unit swingable away from the stitch-forming area of the machine and comprising an elastic strip feeding assembly generally indicated by numeral 12, a metering and/or tensioning assembly therefor generally indicated by numeral 14, and a cutting assembly therefor generally indicated by numeral 16.

Functionally, the invention relates to automatic feeding and automatic cutting of elastic strip material 11 sequentially and at either and selective full, medium or half or no-stretch condition, said strip being used for stitching to circular parts of garments or other goods as the base materials such as 11' where a circumferential band of elastic is required. Waistbands, sleeves, leg parts and the like, as is known, are provided with such elastic stripping or banding.

The structure of the invention may be applied to any known industrial type sewing machine but as shown utilizes a Union Special 39500 QW machine. Thus, screws of the sewing machine cover 18 are removed, and inserted in place thereof are studs 19, leveling nuts 20 and standoffs or spacers 21.

Figure 2:
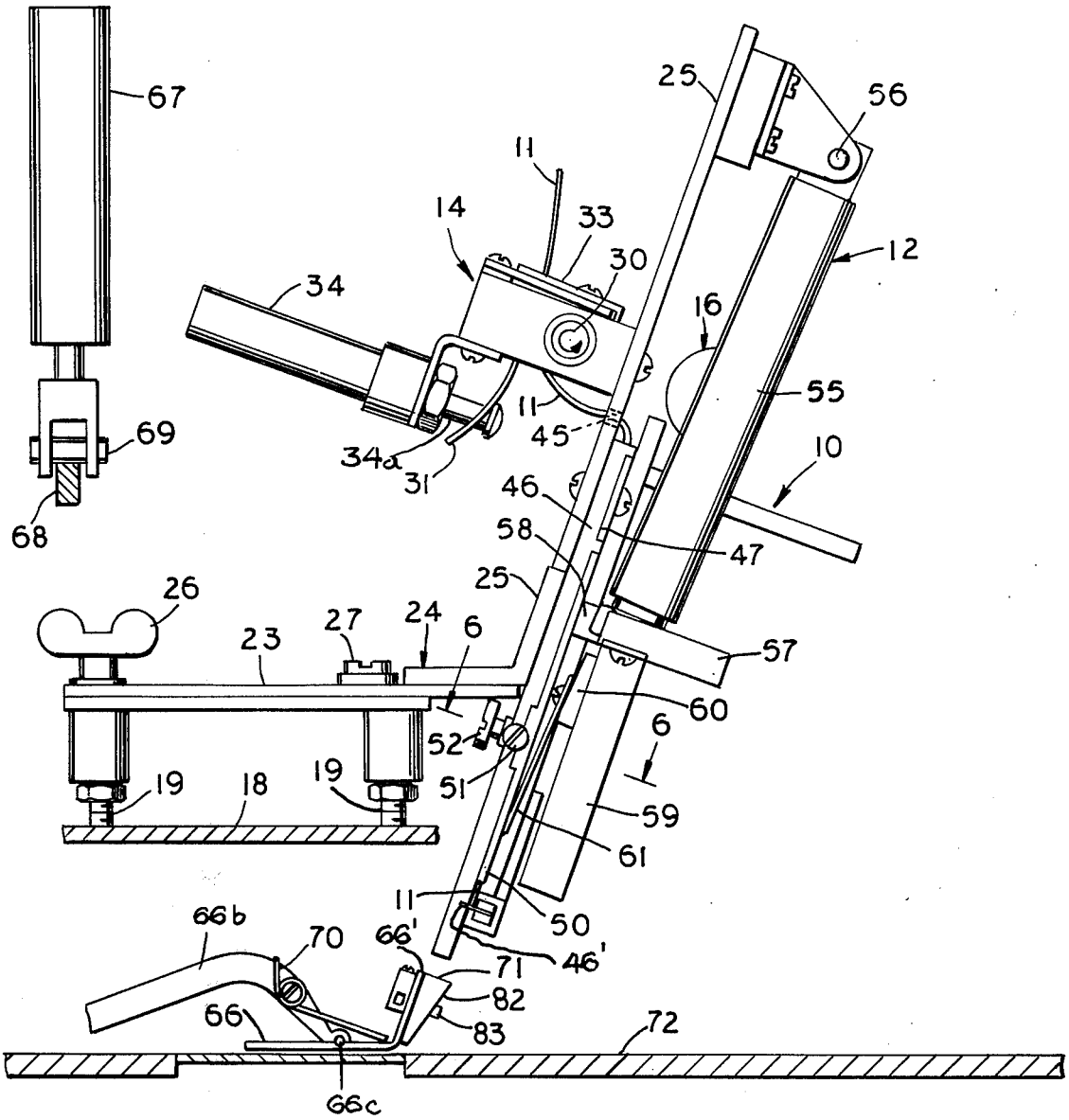
FIG. 2 is a left side view in elevation of FIG. 1 with some parts only partially shown.

A mounting plate 22 is affixed to the standoffs 21 and on which sits the base 23 of an angle plate bracket generally indicated by numeral 24. The bracket portion consists of a main arm 25 and a lateral arm 25', said arms being substantially vertically disposed, but more specifically, preferably and as shown in FIG. 2, 20 degrees off the perpendicular, the tilt being forward from the top. Arm 24 serves to mount the metering, tensioning and feeding systems and affords the pathway for overhead guidance system for elastic strip 11, while arm 25 carries the cutting system.

Base 23 of bracket 24 is suitably held in position as by a quick release (thumb) screw 26 (operating in an arcuate slot not shown) and a pivot screw 27. By opening screw 26, angle plate bracket 24 supporting assemblies 12, 14 and 16, may be swung about pivot 27 freeing the stitching area of the sewing machine to accomodate for threading of the machine, changing of needles, repair, etc.

METERING AND/OR TENSIONING

Suitably mounted on the rear and intermediate the height of main arm 25 is the metering and/or tensioning assembly 14 (see FIGS. 4 and 5), and which is comprised of a U-shaped bracket 28, a knurled roller 29 on a shaft 30, a shaped spring 31 engageable with said roller, a slotted cover plate 32 and strip material adjusting plates 33 to accommodate for varying widths of elastic strip 11.

Figure 13:
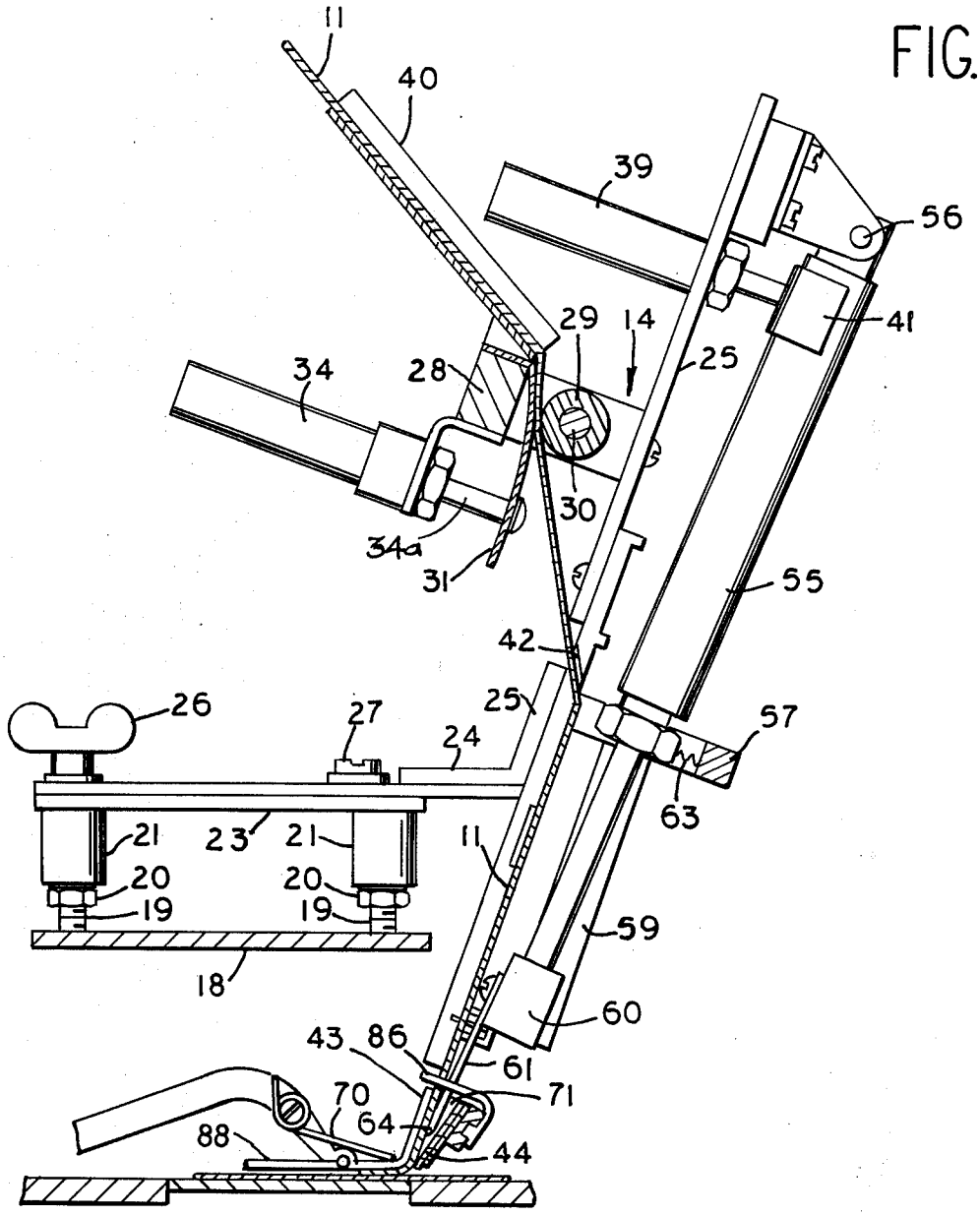
FIG. 13 is a left side view in elevation of a third fluidic embodiment of the invention, partly in section showing the elastic strip feed finger at the end of a feed stroke.
Figure 14:
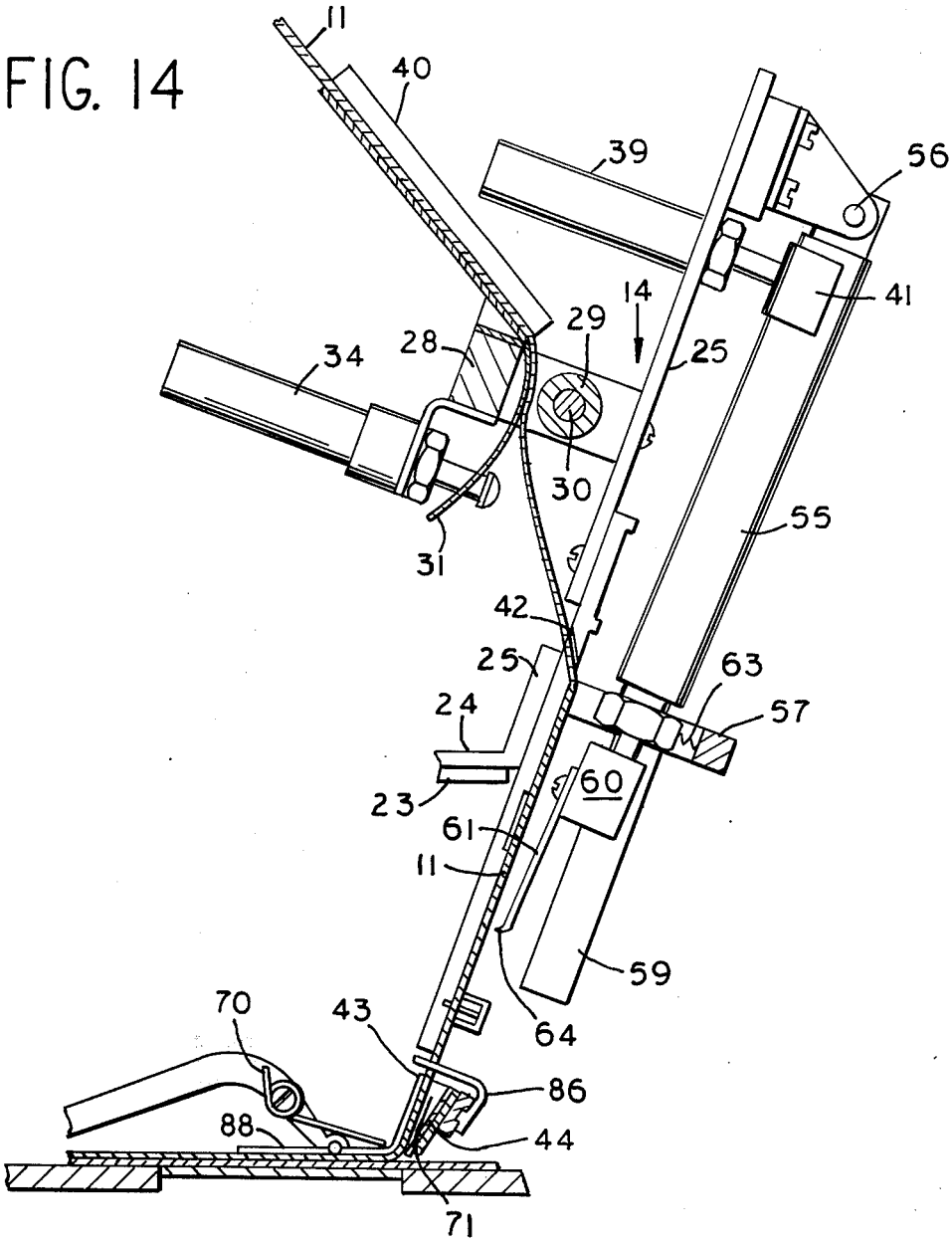
FIG. 14 is a view similar to FIG. 13 except that the fluidic-operated air cylinders are in position for continuing sewing operation with the feed finger retracted and disengaged from the elastic strip.

Suitably attached to the underside of U-shaped bracket 28 by means of angle 38 (FIG. 5) is cylinder 34 carrying the reciprocable rod 34a and having attached thereto said spring 31 for tensioning engagement with elastic strip 11 disposed against roller 29 (see FIGS. 5, 13 and 14). Cylinder 34 can be characterized as the stretch and no stretch controlling cylinder, preferably fluidically operated, in conjunction with the machine work feeding means or feed dog (not shown) as will hereafter appear.

Elastic strip 11 as best seen in FIGS. 2, 4, 13 and 14, coming from an overhead source as from a roll, passes through the housing of the metering assembly 14 between spring 31 and roller 29. As shown roller 29 through shaft 30 is rotated counterclockwise by a flexible shaft 35 which connects to a variable speed drive assembly generally indicated by numeral 36 and is suitably mounted on table 72 (FIGS. 1 and 3). Associated therewith is a speed control cylinder 73 (FIGS. 1 and 3) mounted at its rear and by a pivot (not shown) thereby permitting said cylinder to pivot along its latitude line. The opposite end of speed control cylinder 73 has a rod end bearing 74 which rides on and moves the variable speed drive speed control lever 75.

A stationary arm 76 is affixed to speed control cylinder 73 and a movable arm 77 is affixed to the cylinder rod 78. At a signal from an air switch, not shown, the rod 78 retracts until arm 77 riding on threaded stud 81 hits for an adjusted position nylon washer stop 80. Similar operation takes place for the forward stroke against a spaced and similar nylon washer stop. It is to be noted that stud 81 is a fixed member that is threaded and locked onto arm 76.

When cylinder rod **34*a* is in retracted position, it pulls back spring 31 allowing elastic strip 11 to ride free through the metering assembly 14 (FIG. 5) and when in extended position (FIG. 13), said rod 34*a* through spring 31 tension elastic band or strip 11 against the knurled roller 29. Roller 29 rotates in the same direction of travel as elastic strip 11 but at a slower speed than work-feeding movement of the machine feed dog, said speed being controlled by the variable and flexible speed drive shaft 35**.

Thus, a substantially medium (half) or full-stretch condition of feed from the metering assembly 14 occurs when elastic strip 11 is introduced or inserted into the stitch-forming area above the base material 11' and under the presser foot as will appear. The stretch of elastic strip 11 is effected as above stated by the difference in speed of drive shaft 35 and the movement of the base material 11' carried forward by the machine feed dog during the sewing operation.

By adjusting plates 33, elastic strip 11 can pass through the metering assembly in varying widths as up to 1½ inches. Increased size of the metering assembly would be required for wider elastic stripping.

Elastic strip 11 continues through a slot 45 in the main arm 25 from the underside of the housing of metering assembly 14 and down through the guiding system provided on the front face of main arm 25.

GUIDING AND FEEDING

As shown a downwardly extending and longitudinal guide plate assembly my be formed on the front face of main arm 25 and is generally designated by numeral 46. The upper portion of guide plate 46 carries a cover 47 to form a chute to prevent elastic strip 11 from looping out from below said cover during feed.

Elastic strip 11 proceeds along guide plate 46 as the feed path, said path being designated by numeral 48. The lower open part of guide plate 46 may have one side fixed as at 49, while the other side 50 is adjustable for opening or closing for accommodating various widths of elastic band 11. (See FIGS. 2 and 6). Thus, by adjusting screw 51 which has a predetermined length of shank to move adjustable side 50 to desired position in a retainer slot 37 and locking with screw 52, the feed path 48 can be adjusted to any width of strip or band 11. Moreover, the inner edge of adjustable side 50 of the strip plate guide 46 adjacent the undersurface (FIG. 6) is shown as having a longitudinal cutout 54 to retain and guide one edge of elastic strip 11 travelling along feed path 48.

A fluidically controlled cylinder 55 carrying its operating rod **55*a* and herein designated as the feed cylinder controls operation of a feed finger 61 along the feed path 48 and is suitably mounted on the front face of main arm 25 as seen in FIGS. 2, 13 and 14. As shown, the upper end of feed cylinder 55 is pivotally held by a pivot pin 56 in a suitable bracket on arm 25 and at the lower end is housed inside of U-shaped housing 57. The latter is secured to main arm 25 at the end of one of the housing legs, the other leg being open as at 58 for permitting adjustment of member 50 of the guide plate 47**.

A guide screw 62 in U-shaped housing 57 (FIG. 7) controls the positioning of pivoted feed cylinder 55 and in consequent adjustment of pressure for forcing the offset row of teeth 64 of a blade type of finger 61 transversely across and into elastic strip 11 so as not to have any distortion or slippage. on the feed stroke as will appear.

Thus attached to the underside of housing 57 are two guide rails 59 serving as retainers for movement of feed finger block 60 attached to feed cylinder rod 55*a*. Block 60 carries the feed finger 61 for operation with respect to elastic strip 11 travelling in feed path 48. It is to be noted that feed finger 61 as shown (FIG. 1) is made to accommodate for the smallest width of elastic band or strip, namely 3 inches.

PRESSER FOOT, GUIDE THROAT AND OPERATION

In utilizing the invention, the sewing machine presser foot generally indicated by numeral 66 is modified to incorporate a guide throat or funnel as best shown in FIGS. 2 and 8. Thus, an adjustable width funnel 71 aligned with angle bracket 24 is secured to an angular presser foot wall portion 66'. Presser foot 66 is carried on a bracket 66*b* and as shown is of a pivoted type as at 66*c*, bracket 66*b* carrying a torsion spring 70 bearing on the forward part of foot 66 to increase both hold down power on base material 11' and ease of entry of elastic strip 11 from the funnel exit on downward stroke of feed finger 61 as will appear.

The adjustable width guide throat or funnel formation 71 receives through the mouth thereof elastic strip 11 from the lower end of tilted arm 25 which is spaced from and substantially aligned therewith on the downward stroke of feed finger 61. This arm tilt gives the suspended end of the delivery portion greater freedom of movement along the funnel walls, minimizes friction and reduces rollback and folding.

As seen in FIGS. 2 and 8, funnel 71 is formed from an upstanding front presser foot wall 66' aforementioned and carrying an inturned side wall 66*a*, walls 66' and 66*a* serving as permanent funnel rear and side walls respectively. A funnel front face plate 82 carrying an inturned side wall 82*a* serves as the movable or adjustable front and opposite sidewall of the funnel. Movable adjustment of elements 82 and 82*a* is accomplished by having welded to plate 82 one arm of a U-shaped key 83, the other arm riding in a keyway 84 of a block 85, the latter being welded to the rear face of presser foot wall 66'. Key 83 is secured by a screw 85' in its adjusted position by passing through the top of block 85 and penetrating the keyway 84.

As best seen in FIG. 1 a presser foot lifter lever cylinder 67, a spring return non-rotating type as used herein, when activated, pushes downward on the foot lifter lever 68 thru a free turning pin 69 and is adopted to lift the presser foot 66 preliminary to insertion of base material 11' or the circular garment part requiring elastic banding.

CUTTING MEANS

Lateral arm 25' carries the cutting assembly 16 as shown in FIGS. 1 and 2. Formed with or secured to the lower part of arm 25' and transversely of the feed path of elastic strip 11 is an elongated housing 151 having a projecting inner end and square-shaped portion 152. A sliding knife block 153 carrying a knife blade 154 at the end thereof is adapted to be reciprocated for projection of the blade 154 across and for cutting the travelling elastic strip 11. Blade 154 moves across the lower part of guideplate 46 in a transverse slit 46' (FIG. 2)

Housing 151 has a longitudinal slot 155 along the top wall thereof for projection of a pin 156 carried by knife block 153. Pin 56 is reciprocable along said slot 151 by means of a lever 157, the latter having at the lower end a short slot 158 and having mounted therein a riding block 159 and through which pin 156 penetrates.

Lever 157 by suitable linkage and driving means is adapted to cause reciprocation of knifeblock 153 by oscillation between a pair of adjustable and spaced eccentric members 160, the latter being mounted on lateral arm 25' by means of screws 161. Lever 157 is pivoted to said arm 25' as at pivot screw 162. The outer end of lever 157 is pivotally connected to fluidic cylinder 163 herein designated as the knife blade cylinder. As shown in FIG. 1, cylinder rod 164 carries a yoke block 165 at its end, the said block pivotally mounting the lever 157 as at pin 166, while the cylinder itself is pivotally mounted on lateral arm 25' as by a bracket 167, the latter being suitably attached also to arm 25'.

A fluidic control unit (not shown) sequences the cyclic operation of feed cylinder 55 for insertion of elastic strip 11 to the stitch forming area or under presser foot 66 and the cyclic operation of the knife blade cylinder 163 for cutting of the strip 11. A knee switch (not shown) under the operator's control effects these sequential operations as will now appear.

MODE OF OPERATION FOR FULL STREECH

1. In operation, the machine operator depresses an air foot switch (not shown), actuating presser foot lifter cylinder 67 through the suitable linkage thereby causing presser foot 66 to be raised (FIG. 1 and 2). The operator then inserts the circular part of the garment or other goods and then releases the air foot switch causing the presser foot 66 to return and engage the garment part preparatory to sewing.

2. A switch such as a toggle type air switch (not shown) is used to determine the speed of the variable speed drive through speed control cylinder 73. The slower speed setting is as shown in FIG. 1 and 3 for operation of the full stretch condition of elastic stretch 11.

3. The operator then activates the aforementioned knee switch and three sequential steps take place:

a. Metering or tensioning air cylinder 34 advances its rod 34*a* thereby causing spring 31 to tension elastic strip 11 against roller 29 as in FIG. 13 sub-assembly.

b. Feed air cylinder 55 advances its rod 55*a* and feeds elastic strip 11 into funnel 71 through feed finger 61 at the edge tooth portion 64 as in the relevant sub-assembly in FIG. 13.

c. Feed air cylinder 55 in its return cycle retracts rod 55*a* to complete its cyclic operation and carries back feed finger 61 in riding or sliding engagement with the elastic strip 11 for the duration of the sewing operation. (Compare relevant sub-assembly Embodiment III hereafter to be described and as shown in FIG. 14 wherein the feed finger 61 is disengaged from strip 11 on the return stroke for reasons therein set forth.)

4. Sewing operation is now commenced as by the operator's use of a pedal or foot switch (not shown).

5. When sewing operation is near completion, as near the end of the circumference of the sewn elastic strip 11 to the base material 11' for butt juncture to prevent overlap, or at the end of the circumferential sewing of strip 11, the knee switch is again activated for the cutting cycle of air cylinder 163 and sewing operation is completed. Cylinder rod 34*a* is then retracted at the return part of its cycle drawing spring 31 away from elastic strip 11 (FIG. 5).

It is to be noted that the relevant sub-assembly of FIG. 13 of Embodiment III is applicable to Embodiment I in showing the relative engaging positions of feed finger 61 with respect to elastic strip 11 at the end moment of the feeding stroke. The relevant sub-assembly of FIG. 14 of Embodiment III shows continuous feeding of elastic strip 11 with feed finger in retracted and disengaged position. In Embodiment I, the feed finger is in ridable engagement with the strip 11 during the step of retraction and thereafter during continuous feed.

After the cutting operation feed finger is in engaging or clamping position (FIG. 7) with respect to strip 11, said clamping effect permitting the strip portion below the clamping area to relax; while the strip portion above the clamping area relaxes by virtue of the withdrawal of clamping plate 31 from strip 11 (FIG. 5).

MEDIUM OR HALF-STRETCH

It is to be observed that the above operations have been described for sewing at substantially full-stretch of elastic strip 11. For half-stretch or medium-stretch conditions, the same steps take place except that the variable speed drive is set for a faster speed.

NO-STRETCH

Conditions for no-stretch do not involve changing the speed of variable drive 36 because whether roller 29 is rotating continuously at either speeds, the cylinder 34 is held in the retract position at the operator's convenience by use of an override foot switch (not shown) thereby allowing elastic band 11 to ride free. The knee switch is activated as in conditions of full and half or medium stretch, but the override is used constantly.

Above three conditions may be obtained on the circular part of the same garment or other goods.

Thus an operator can sew an elastic strip without stretch, with medium stretch or with full stretch, all within the operator's control. For instance, when sewing elastic into the leg opening of a swim suit bottom, operator presses the foot pedal to bring stretch air cylinder into retract condition, then operator can go to full-stretch by releasing the foot pedal, then back to no-stretch by again pressing the foot pedal. By moving a lever for faster speed of the variable speed drive, the operator can switch to medium stretch as for waist operations.

EMBODIMENT II

The second embodiment is a manual method of obtaining the three conditions of stretch and is covered in FIGS. 9, 10, 11 and 12. This method is used when the accuracy of a metered feed is not required.

Like parts, assemblies and sub-assemblies as in Embodiment I are designated by corresponding reference numerals.

Thus from FIG. 9, studs 93 each pass through clearance openings in the wings of a pressure plate 92 and are affixed to main arm 25. Spring 95 around each of the studs is controlled by nut 94 to adjustably tension pressure plate against elastic strip 11 and clamp same against the face of arm 25. In this embodiment, the upper area of guide plate 46 is removed.

An adjustable cam 97 rides on a shaft 98, the position of the cam being controlled by lever 96. When lever 96 is horizontal, pressure plate 92 applies maximum pressure against band 11 giving a full stretch condition (FIG. 10). When lever 96 is in perpendicular position pressure plate 92 is cammed out thus creating a half or medium stretch condition on elastic strip 11 (FIG. 11).

FIG. 12 shows the no-stretch condition by the expanded condition of cylinder 34*b* as by use of a foot switch (equivalent to retracted condition of cylinder 34 in Embodiment 1). In this condition pressure plate 92 exerts no pressure on elastic strip 11, and rests at the bottom on spaced supports 92*a*.

A travel control bracket 99 is mounted on the main arm 25 and is adapted to control the rotation of lever 96 by stops 100. A guard 91 is provided in this embodiment.

MODE OF OPERATION OF EMBODIMENT II

It is seen that Embodiment II operates similarly to Embodiment I except that the metering assembly 14 including the variable speed drive is omitted. Stretch cylinder 34 of Embodiment I is modified as by cylinder 34*b* (FIG. 12) operable for no-stretch purposes at the extended condition to disengage plate 92 from strip 11 as at plate ear 92*b*. Otherwise the operations of Embodiment I are applicable to Embodiment II.

EMBODIMENT III

Figure 15:
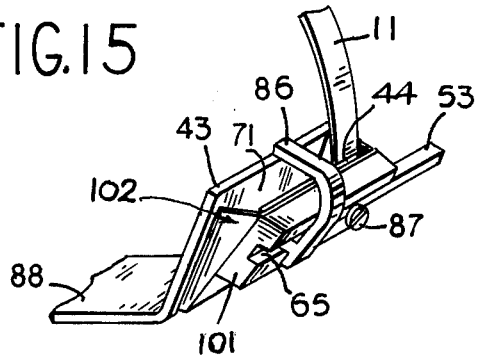
FIG. 15 is another form of a guide throat type of presser foot as used in the embodiment of FIG. 13 and 14.

In use of non-webbed, soft and extremely elastic material as solid rubber or equivalent synthetic material or the like, and where no restriction or clamping effect is permissible as for a no-stretch condition to avoid shirring or ruffling on the base material, the structure and system of Embodiment I of the invention are modified as seen in FIGS. 13–15.

All parts of the feeding assembly 12, the metering assembly 14 and cutting assembly 16 remain substantially the same except for elimination of angular and other contacting areas along the strip path such as guide plate cover 47. Sequence of operations changes slightly as will appear.

Strip 11 is carried by an overhead and inclined track 40 suitably attached to the bracket 28 of the metering assembly and fed into the feed path of guide plate 46 through an inclined slot 42 in main arm 25 as seen in FIG. 13 to minimize drag as much as possible.

Strip 11 is carried by feed finger 61 into guide throat or funnel 71 of a modified presser foot 88 (FIG. 15) in the downward stroke condition of cylinder 55, and is captured between presser foot upright portion 43 and a hairpin type springwall 44. The modification of presser foot 88 over 66 of Embodiment I is made necessary for adjustability because of use of spring 44 in the funnel formation. Thus (FIG. 15) a bar 86 is welded to key 53 which rides in a keyway 65 of a block 101. On the forward face of presser foot upright portion 43 is secured a plate formation 102 having a wall member and lateral triangular ears extending inwardly, the upright edge of said ears being secured to said face to form funnel or guide throat therewith.

A block 101 is suitably secured to the outer face of the wall member 102 and spring 44 is suitably connected to the inner face of the wall member. Key 53 is held in adjusted position in any suitable manner as by screw 87. Thus, the width of elastic strip 11 is adapted to be held between one of the ears of plate formation 102 and the adjustable bar 86.

Spring 44 as mentioned is adapted to prevent the folding or rolling back of the extremely stretchable elastic strip during feed from the exit of funnel 71.

Moreover, feed finger 61 is held away from the strip 11 on its return stroke (FIG. 14) as by the extended condition of cylinder 39 mounted on arm 25 and connected to cylinder 55 by clip 41. Such arrangement is adapted to reduce the friction of engagement on strip 11 by feed finger 61 and consequently does not serve as a guide during the sewing operation and travel of strip 11 as in previous embodiments. In addition, the metering assembly 14 whether operating under a slow or faster speed acts only as a clamping device during the feed stroke of finger 61. Thereafter spring 31 of the metering assembly 14 is retracted and feed finger 61 disengaged from strip 41 as above stated.

It is to be noted that spring 63 is also adjustable for increase of tension on feed finger 61.

MODE OF OPERATION EMBODIMENT III

As in Embodiment I, the machine operator depresses an air foot switch activating cylinder 67 through linkage in the sewing machine and the foot 88 is raised for insertion of base material 11'.

The toggle type air switch for change of speed drive 36 is not used because whether flexible shaft 35 is going at fast or slow speeds, speed of rotation of roller 29 is immaterial since Embodiment III is concerned with no-stretch condition of strip 11.

The knee switch, however, is similarly activated as in Embodiment I for sequential steps to occur. Thus, cylinder 34 is put into advanced condition forcing spring 31 to tension strip 11 against roller 29; cylinder 55 is in advanced condition for feeding elastic strip into funnel 71 through feed finger 61 with proper phasing, and following such feed by finger 61, cylinder 39 is activated for advanced condition and pivots cylinder 55 about pin 56 thereby disengaging finger 61 from strip 11. Cylinder 34 goes into retracted condition and sewing operation commence.

After sewing operation is either completed or about completed as in Embodiment I, the knee switch is again activated, cylinder 39 goes into retracted condition thereby allowing feed finger 61 to engage strip 11 and clamp same while the cutting cycle takes place.

It is understood that although mechanisms, controls, activating means and other devices for phasing, cycling and sequential operations may be powered by pneumatic, hydraulic, electromechanical, electrical or electronic means or combinations of such means, compactness and arrangement of the interconnected devices mounted on a swingable bracket dictates major usage of fluidic devices and controls.

It is further understood that minor changes and variations in the integration, size, adjustability and location of parts may all be resorted to without departing from the spirit of the invention and the scope of the appended claims.

I claim:

1. In apparatus for use with a sewing mahine to controllably elasticize circular parts of garments and the like and having stitch-forming means, a presser foot and work-feeding means for feeding the materials to be sewed past the stitch-forming means, said sewing machine and apparatus being adapted to sew a strip of first elastic material to the second material along the circumference thereof and adaptable for power operation, the improvement which comprises: an upright bracket forwardly disposed of the stitch-forming means, a sewing machine cover and means to lockably pivot said upright bracket to said sewing machine cover, said bracket having main and lateral arms, adjustable tensioning means for the said strip for varying stretch thereof and secured on said main arm, first actuating means for said tensioning means also secured to the upper part of said main arm, guide means secured to and disposed along said main arm therebelow for downward path of said strip, a guide throat for said strip spaced from and below said guide means and in substantial axial alignment therewith and leading and connected to the said presser foot, an initiating and returnable feed finger blade transversely engageable with said elastic material strip for movement and introduction of said strip through said guide throat to the presser foot and for takeup by the stitch-forming means, second actuating means operatively carrying said feed finger blade and secured to said main arm, reciprocable cutting means mounted on the lateral arm of said bracket for said strip, and third actuating means operatively connected to said cutting means and also secured to said lateral arm, said cutting being adapted to transversely sever said strip along said guide means during feeding to and sewing operation by the stitch-forming means.

2. In apparatus as set forth in claim 1 wherein said upright bracket is forwardly tilted from the top and said guide throat is substantially in axial alignment therewith.

3. In apparatus as set forth in claim 1 wherein said cutting means includes a knife blade and wherein said guide means has a transverse slot for penetration by the said blade during severance of the strip.

4. In apparatus for use with a sewing machine to controllably elasticize circular parts of garments and the like and having stitchforming means, a presser foot and workfeeding means for feeding the materials to be sewed past the stitch-forming means, said sewing machine and apparatus being adapted to sew a strip of first elastic material to the second material along the circumference thereof and being adaptable for power operation, the improvement which comprises: an upright bracket forwardly tilted from the top and forwardly disposed of the stitch-forming means, a sewing machine cover and means to lockably pivot said upright bracket to said sewing machine cover, said bracket having main and lateral arms, a longitudinal guide path for said strip along the front face of said main arm, adjustable tensioning means for the said elastic material strip for varying stretch thereof and actuating means therefor both secured to the upper part of said main arm and operative on said strip from the rear face of said arm, said main arm having an opening for passage of said strip from the rear to the guide path, strip delivery means comprised of a blade with teeth along the transverse edge thereof to engage said strip transversely thereof and actuating means therefor and both being secured to the front face of said arm, cutting means, activating means carrying said cutting means and secured to said lateral arm for severance of the strip tranversely of the guide path.

5. In apparatus as set forth in claim 4 wherein the adjustable tensioning means comprises a variable speed driven roller, a releasable clamping plate operable by the first mentioned actuating means and between which the elastic strip is disposed and to which the said actuating means is operatively connected.

6. In apparatus as set forth in claim 4 wherein said upright bracket is forwardly tilted from the top at about 20° off the perpendicular and said guide throat is in substantial axial alignment therewith and wherein said cutting means includes a knifeblade and wherein said guide means has a transverse slot for penetration by the said blade during severance of the strip.

7. In apparatus as set forth in claim 4 wherein a substantially axially aligned guide throat is provided being spaced below the lower edge of said main arm and formed with the presser foot for feed delivery of said strip thereto and wherein said guide throat has means for adjustment to accommodate for the width of the strip.

8. In apparatus as set forth in claim 4 wherein the adjustable tensioning means comprises a plate and means for manual adjustment thereof for clamping the elastic strip against the arm and wherein the first mentioned actuating means is operative for release of said plate.

9. In apparatus as set forth in claim 4 wherein said cutting means includes a knifeblade and wherein said guide means has a transverse slot for penetration by the said blade during severance of the strip.

10. In apparatus for use with a sewing machine to controllably elasticize circular parts of garments and the like and having stitch-forming means, a presser foot and work-feeding means for feeding the materials to be sewed past the stich-forming means, said sewing machine and apparatus being adapted to sew a strip of first elastic material to the second material along the circumference thereof and being adaptable for power operation, the improvement which comprises: an upright bracket forwardly tilted from the top and forwardly disposed of the stitch-forming means, a sewing machine cover and means to lockably pivot said upright bracket to said sewing machine cover, said bracket having main and lateral arms, a longitudinal guide path for said strip along the front face of said main arm, adjustable tensioning means for the said elastic material strip for varying stretch thereof and actuating means therefor both secured to the upper part of said main arm and operative on said strip from the rear face of said arm, said main arm having an opening for passage of said strip from the rear to the guide path, strip delivery means comprised of a blade with teeth along the transverse edge thereof to engage said strip transversely thereof and actuating means therefor and both being secured to the front face of said arm, cutting means, actuating means carrying said cutting means and secured to said lateral arm for severance of the strip transverse of the guide path, said adjustable tensioning means comprising a plate and means for manual adjustment thereof for clamping the elastic strip against the arm and wherein the first mentioned actuating means is operative for release of said plate wherein the said plate comprises a main plate member having means for adjustable biasing against the main arm, manually controlled camming means mounted in said arm to adjust degree of tension against the strip disposed between said arm and plate, and said first mentioned actuating means therefor being adapted to disengage said plate from the strip for relief of pressure thereagainst, supporting means on said arm to permit said plate to pivot thereon when the plate is disengaged from the strip.

11. In apparatus as set forth in claim 1 wherein another actuating means is mounted on the main arm and is adapted to offset said second actuating means carrying said feed finger for disengagement of the finger from the elastic strip.

12. In apparatus for use with a sewing machine to controllably elasticize circular parts of garments and the like and having stitch-forming means, a presser foot and work-feeding means for feeding the materials to be sewed past the stitch-forming means, said sewing machine and apparatus being adapted to sew a strip of first elastic material to the second material along the circumference thereof and adaptable for power operation, the improvement which comprises: an upright bracket forwardly disposed of the stitch-forming means, a sewing machine cover and means to lockably pivot said upright bracket to said sewing machine cover, said bracket having main and lateral arms, adjustable tensioning means for the said strip for varying stretch thereof and secured on said main arm, first actuating means for said tensioning means also secured to the upper part of said main arm, guide means secured to and disposed along said main arm therebelow for downward path of said strip, a guide throat for said strip spaced from and below said guide means and in substantial axial alignment therewith and leading and connected to the presser foot, an initiating and returnable feed finger blade transversely engagable with said elastic material strip for movement and introduction of said strip through said guide throat to the pressure foot and for takeup by the stitch-forming means, second actuating means operatively carrying said feed finger blade and secured to said main arm, reciprocable cutting means mounted on the lateral arm of said bracket for said strip, and third actuating means operatively connected to said cutting means and also secured to said lateral arm, said cutting being adapted to transversely sever said strip along said guide means during feeding to and sewing operation by the stitchforming means, further actuating means mounted on the main arm and adapted to offset said second actuating means carrying said feed finger blade for disengagement of the finger blade from the elastic strip, and wherein said cutting means includes a knife blade and wherein said guide means has a transverse slot for penetration by the said knife blade during severance of the strip.

13. In apparatus as set forth in claim 12 wherein said guide throat is provided with a spring on one of its walls for retaining the strip along the exit end and wherein said guide throat is adjustable to accommodate for width of strip.

14. In apparatus as set forth in claim 12 wherein said guide throat is provided with a spring on one of its walls for retaining the strip along the exit end and wherein said guide throat is adjustable to accommodate for width of strip and wherein said guide throat is comprised of an inclined bracket member secured to the front edge of the presser foot, a housing attached to the front face of said bracket to form side walls and a spaced front wall forming at the top an open mouth for strip delivery thereto and at the bottom an open narrower slit for egress of said strip to the presser foot, a block secured to said spaced front wall having a keyway therein, a key movable in said keyway and carrying an offset bar bridging the top and serving as a lateral adjustable wall with one of the housing side walls to accommodate for various widths of the strip, and means for locking said bar in adjusted position.

* * * * *